United States Patent [19]

Colarusso, Jr.

[11] Patent Number: 4,927,555

[45] Date of Patent: May 22, 1990

[54] PROCESS FOR MAKING THIXOTROPIC DETERGENT COMPOSITIONS

[75] Inventor: Remo J. Colarusso, Jr., Wayne, N.J.

[73] Assignee: Colgate-Palmolive Company, New York, N.Y.

[21] Appl. No.: 225,617

[22] Filed: Jul. 26, 1988

Related U.S. Application Data

[63] Continuation of Ser. No. 928,736, Nov. 10, 1986, abandoned, which is a continuation of Ser. No. 640,484, Aug. 13, 1984, abandoned.

[51] Int. Cl.[5] ..... C11D 1/24

[52] U.S. Cl. ..... 252/99; 252/135; 252/174.25; 252/315.01; 252/315.5

[58] Field of Search ..... 252/99, 135, 174.25, 252/315.01, 315.5

[56] References Cited

U.S. PATENT DOCUMENTS

| | | | |
|---|---|---|---|
| 3,148,970 | 9/1964 | Smith et al. | 252/315.5 |
| 4,316,812 | 2/1982 | Hancock et al. | 252/99 |
| 4,740,327 | 4/1988 | Julemont | 252/103 |

FOREIGN PATENT DOCUMENTS 1495549 12/1977 United Kingdom .

*Primary Examiner*—John F. Niebling
*Assistant Examiner*—Isabelle Rodriguez
*Attorney, Agent, or Firm*—Norman Blumenkopf; Robert C. Sullivan; Murray M. Grill

[57] ABSTRACT

Process for making a thixotropic detergent slurry, particularly suitable for use in making compositions useful in household automatic dishwashers. A slurry of particles of alkaline water-soluble builder salt, particularly sodium tripolyphosphate, is formed in a liquid containing dissolved alkaline builder salt, such as alkali metal carbonate. The proportion of solid particles is so high that the slurry has a viscosity of about 20,000 to 60,000 centipoises. This viscous slurry is subjected to wet grinding with a high speed disperser. Water and powdered clay are then added and the clay is deagglomerated in the mixture by mechanical action. Improved compositions containing limited amounts of potassium compounds and water-soluble polymers are also disclosed.

18 Claims, 4 Drawing Sheets

EXAMPLE 4

EXAMPLE 5

EXAMPLE 6

PROCESS FOR MAKING THIXOTROPIC DETERGENT COMPOSITIONS

This application is a continuation of application Ser. No. 928,736, filed Nov. 10, 1986 abandoned 8/24/88 which is a continuation of application Serial No. 06/640,484 filed Aug. 13, 1984 now abandoned.

One aspect of this invention relates to an aqueous thixotropic automatic dishwasher detergent comprising a liquid phase which is water containing dissolved tripolyphosphate, silicate and alkali metal ions and a dispersed non-swelling clay thickener (preferably attapulgus clay) and a solid phase which is mainly sodium tripolyphosphate. The composition preferably also contains a chlorine bleach (advantageously dissolved sodium hypochlorite) and a bleach-resistant anionic surfactant. It also preferably contains an alkali metal carbonate. U.S. Pat. application Ser. No. 4,740,327 Apr. 26, 1988 discloses certain compositions of this type and its entire disclosure is incorporated herein by reference.

It has now been found that greatly improved results are obtained by including a limited proportion of a water-soluble potassium compound, e.g., a potassium salt (or KOH), in the composition, to provide a K:Na weight ratio which is in the range of about 0.04 to 0.5, preferably about 0.07 to 0.4 such as about 0.08 or about 0.15. The resulting product is much more stable in that it has less tendency to thicken undesirably or separate on aging at, say, 100° F. Also, substitution of a portion of the sodium salt by the same weight of the corresponding potassium salt results in a considerable reduction in viscosity (e.g. as measured with a Brookfield HATD viscometer, at 25° C. at 20 rpm using spindle #4), greater stability against separation on aging (e.g., at room temperature), and inhibition of growth of relatively large crystals on storage. The reduction in viscosity makes for easier handling in the production plant, easier dispensing in use, and makes it easier for the consumer to destroy the thixotropic structure of the product (by shaking the container in which it is packaged) so that it can be poured readily into the detergent cup(s) of a household automatic washing machine.

In the formulation of the product the proportions and ingredients set forth in the above-mentioned U.S. Pat. No. 4,740,327 may be employed. In that application, one set of ranges of proportions is, approximately, by weight:

(a) 8 to 35% alkali metal tripolyphosphate,
(b) 2.5 to 20% sodium silicate,
(c) 0 to 9% alkali metal carbonate,
(d) 0.1 to 5% chlorine bleach stable, water-dispersible organic detergent active material,
(e) 0 to 5% chlorine bleach stable foam depressant,
(f) chlorine bleach compound in an amount to provide about 0.2 to 4% of available chlorine, and
(g) thixotropic thickener in an amount sufficient to provide the composition with thixotropy index of about 2.5 to 10.

Preferably, in the compositions disclosed herein, the proportion of sodium tripolyphosphate is above 15% (more preferably in the range of about 20 to 25 or 30%). The proportion of sodium silicate is at least about 4% (such as in a range of about 5 to 10 or 15%). The proportion of alkali metal carbonate is about 2 to 6 or 7%. The proportion of chlorine bleach is such as to provide above 0.5% available chlorine (e.g., about 1 to 2% available Cl). A solution containing about 0.2 to 2 weight percent sodium hypochlorite contains or provides roughly about the same percent of available chlorine. About 0.8 to 1.6 weight percent of available chlorine is especially preferred. The detergent active materials useful herein must be stable in the presence of chlorine bleach. The detergent active materials are used in amounts ranging from about 0.1 to 5%, such as 0.5 to 2%, and preferably 0.3 to 0.8%. The detergent active material can also be used in an amount of 0.1 to 0.5%. Calculated as $SiO_2$, a preferred range of proportions of sodium silicate represents about 3.5 to 7 $SiO_2$ in the composition. The thixotropic clay thickeners can be used in an amount of about 1.5 to 10%, such as about 1 to 5%, for example 2 to 5%, but in any event the clay thickeners are used in an amount sufficient to ensure the desired thixotropic properties.

The proportion of water in the compositions (measured by "Cenco moisture analyzer" (in which the sample is heated, by an infrared lamp, until it comes to constant weight) is preferably in the range of about 40–50% more preferably about 43–48% such as about 44 to 46%.

The compositions disclosed herein usually have pHs well above 11 or 12. In one preferred type of formulation, the composition when diluted with water to 0.75% concentration has a pH in the range of about 10.7 to 11.3.

The composition disclosed herein are preferably formulated to have viscosities (measured with a Brookfield HATD viscometer at 25° C. at 20 rpm using spindle #4) of less than about 8000 centipoises and more preferably in the range of about 2,000 or 3,000 to 7,000 centipoises such as about 4,000 to 6,000 centipoises. The viscosity, and other properties, may be measured several days (e.g., a week) after the composition is prepared; it is good practice to shake the sample before measuring its viscosity and to let the viscometer run for some 90 seconds before taking and reading.

The compositions disclosed herein have yield values well above 200 dynes per $cm^2$ and are preferably formulated to have yield values of less than about 1100 dynes/$cm^2$ and more than about 300 dynes/$cm^2$, more preferably less than about 900 dynes/$cm^2$, such as about 400 to 600 dynes/$cm^2$. The yield value is an indication of the shear rate at which the thixotropic structure breaks down. It is measured with a Haake RV 12 or RV 100 rotational viscometer using spindle MVIP at 25° C. with a shear rate rising linearly in 5 minutes (after a 5 minute rest period) from zero to 20 sec. $^{-1}$. In the Haake viscometer, a thin layer of the material is sheared between a rotating cylinder and the closely adjacent cylindrical wall of the surounding container.

Another factor measured wth the aforesaid Haake viscometer is the degree to which the composition recovers its thixotropic structure. In one measuring technique after the 5 minute period of increasing shear rate mentioned above, the rotation is decelerated to zero over 5 minutes then after a 30 second rest period the rotation is again accelerated to raise the shear rate linearly in 5 minutes from zero to 20 sec.$^{-1}$. This gives a second yield value, i.e. peaks $Y_r$ in FIG. 1. Preferably this second (recovered) yield value is at least 200 dynes/$cm^2$, such as 50%, 75% or more of the initially measured yield value.

Figure 1:
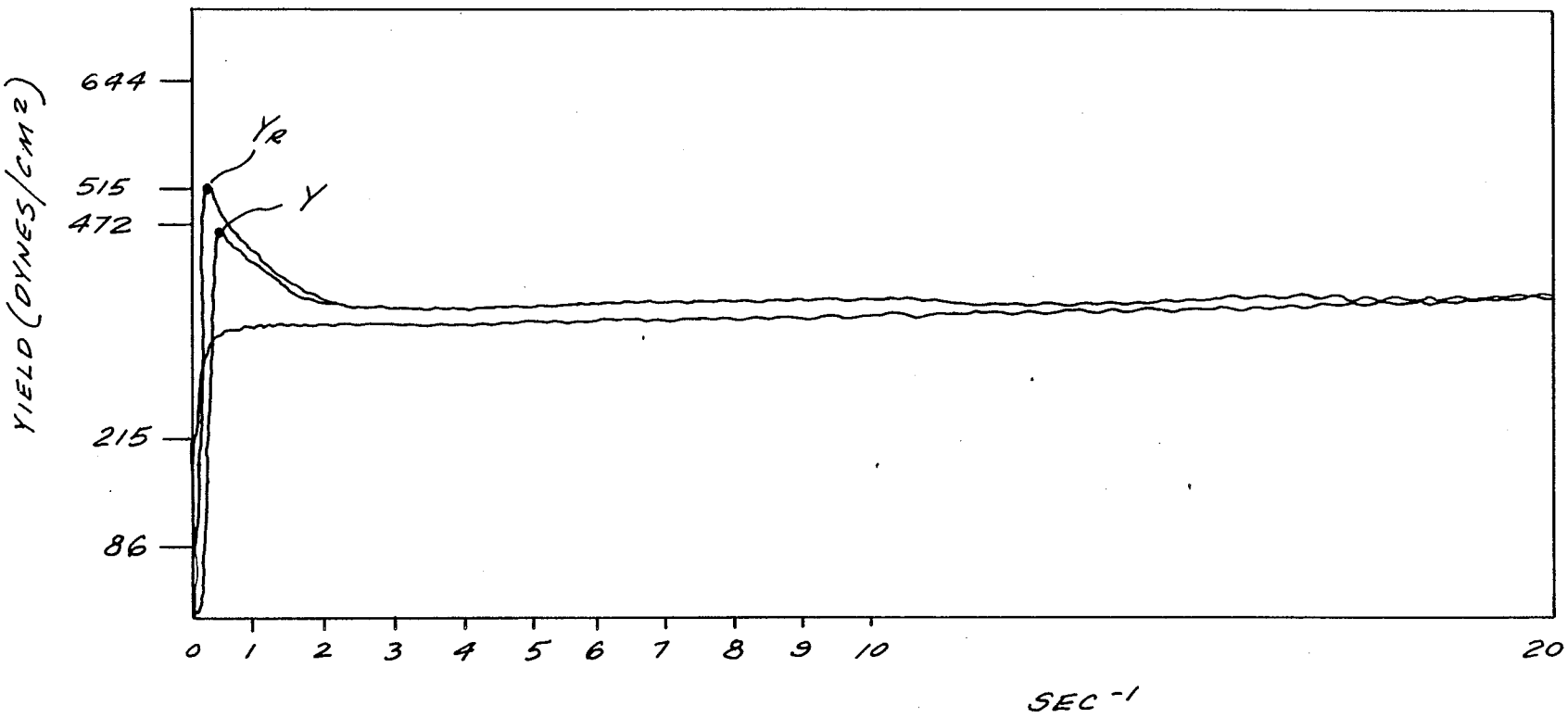
FIGS. 1–3 are graphs obtained in such testing of the products of the three Examples indicated thereon, with the peaks Y showing the yield values.
Figure 2:
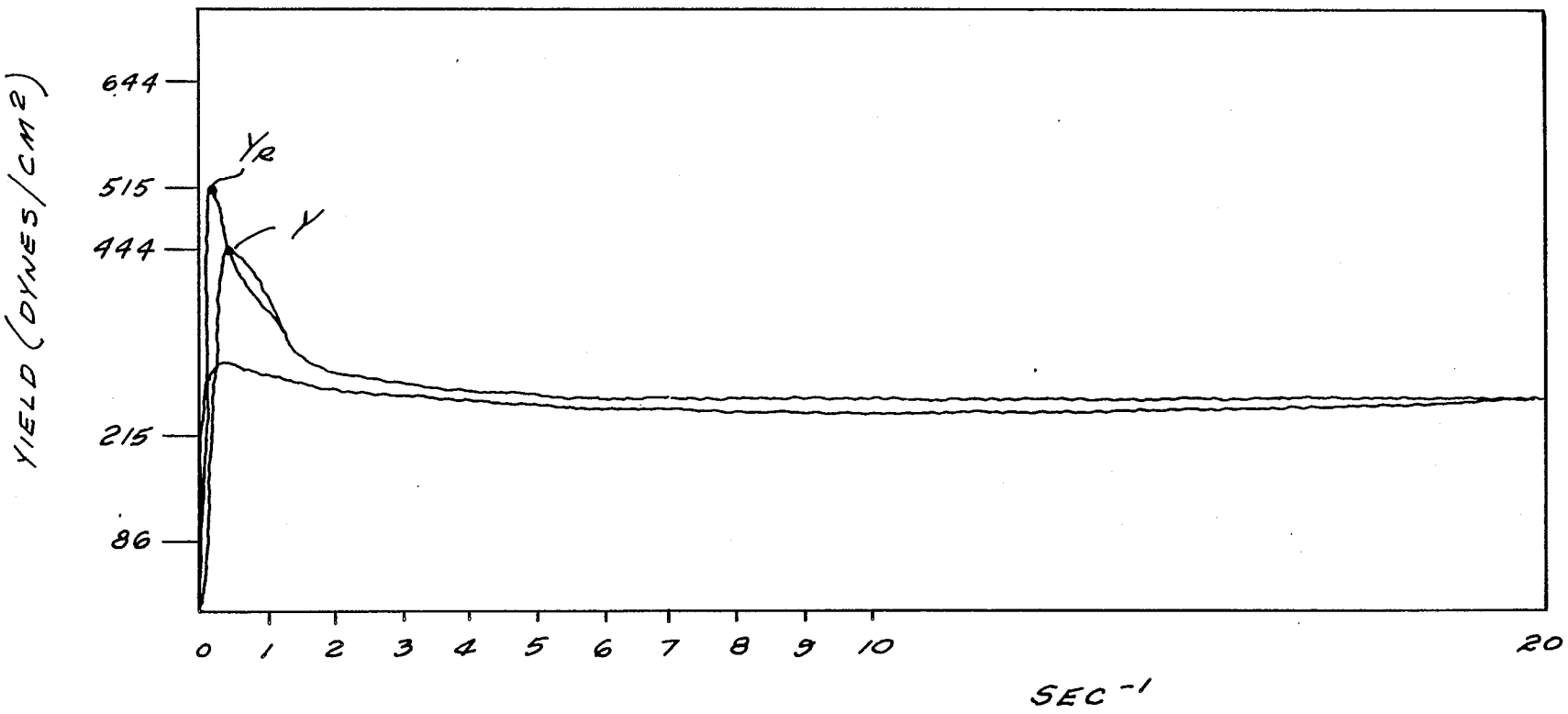
Figure 3:
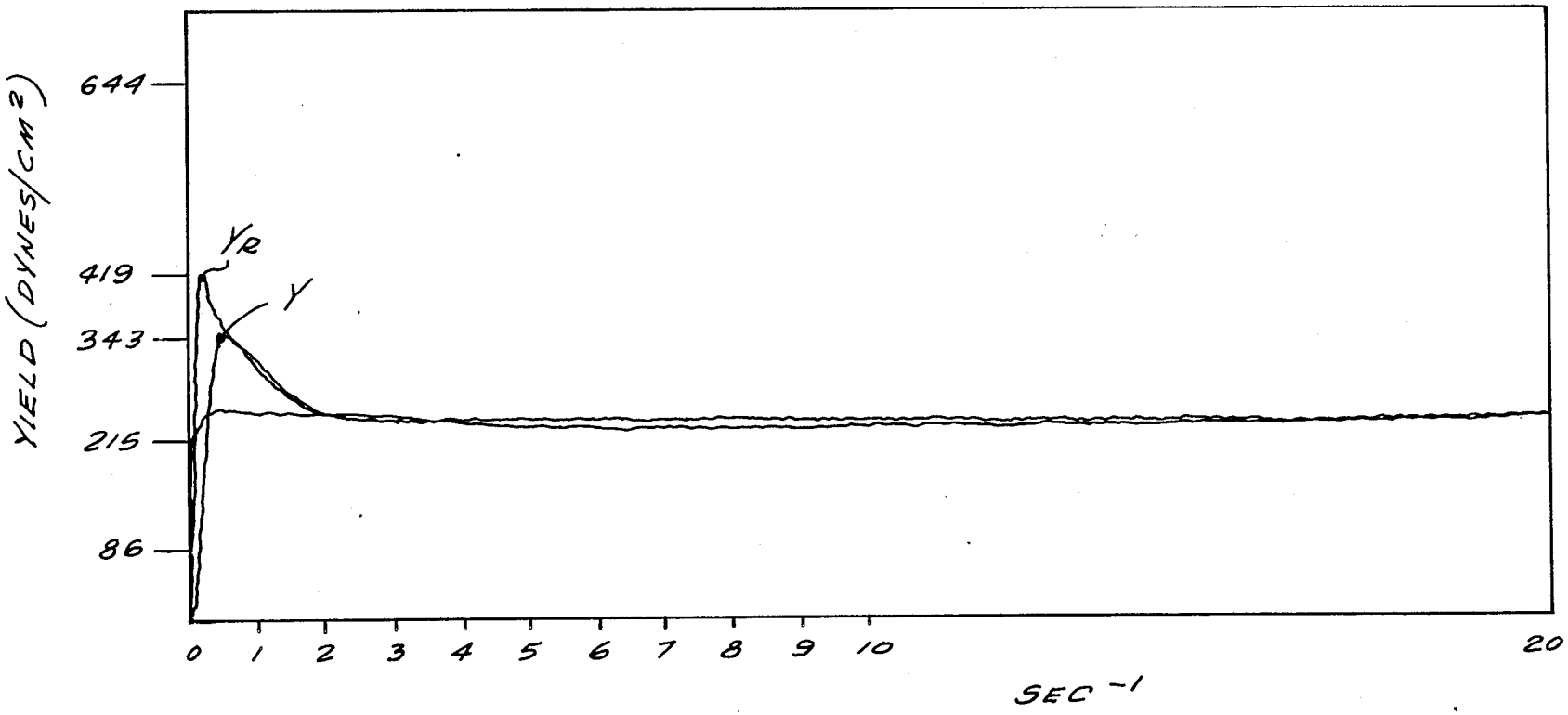

The following Examples are given to illustrate this invention further.

In these Examples, Attagel #50 is powdered attapulgite clay (from Engelhard Minerals & Chemicals, whose trade literature indicates that, as produced, it contains about 12 wt.% free moisture, as measured by heating at 220° F., and has a B.E.T. surface area of about 210 $m^2/g$ calculated on a moisture-free basis); Graphtol Green is a coloring agent; LPKN 158 is an antifoam agent from American Holchst (Knapsack) comprising a 2:1 mixture of mono- and di- ($C_{16}$–$C_{18}$) alkyl esters of phosphoric acid, the sodium silicate has an $Na_2O:SiO_2$ ratio of 1:2.4; Dowfax 3B2 is a 45% aqueous solution of Na monodecyl/didecyl diphenyloxide disulfonates, a bleach-resistant anionic surfactant; STPP is sodium tripolyphosphate. Unless otherwise indicated, the STPP is added in the form of the finely powdered commercial anhydrous material whose water content is about 0.5%, in such material typically about 4.5–6.5% of the material is present as the pyrophosphate. The water used is deionized water unless otherwise indicated.

EXAMPLE 1

The following ingredients are added to a vessel in the order given below while mixing with a conventional propeller-type laboratory stirrer. The temperatures and mixing times at various stages are also indicated below:

| | mass(g) | temperature(°F.) |
|---|---|---|
| 10% Graphtol green (color) | 5 | |
| 130° F. water | 1746 | |
| molten LPKN 158 (antifoam) | 8 | |
| Dowfax 3B2 (surfactant) | 40 | |
| | | 126 (2 min) |
| 9:1 mixture of Attagel #5 and $TiO_2$ white pigment | 180 | |
| | | 122 (1 min) |
| | | 120 (3 min) |
| soda ash | 275 | |
| $K_2CO_3$ | 75 | |
| | | 134 (1 min) |
| | | 132 (3 min) |
| Finely powdered STPP hexahydrate | 750 | |
| | | 127 (1 min) |
| | | 125 (3 min) |
| | | 124 (5 min) |
| 47.5% aqueous solution of sodium silicate premixed with | 421 | |
| 50% aqueous solution of NaOH | 150 | |
| | | 118 (3 min) |
| 13% aqueous solution of NaOCl | 500 | |
| | | 108 (3 min) |
| Finely powdered STPP hexahydrate | 750 | 108 (1 min) |
| Total | 5000 g | 107 (5 min) |

The viscosity of the mixture, measured as indicated above, is about 5000 centipoises after aging for 3 weeks at 100° F. and is about 4800 centipoises after 3 months aging at 100° F.

In this Example, the STPP hexahydrate has the following approximate size distribution:

| U.S.S. Sieve | % |
|---|---|
| on #10 | 0 |
| on #40 | 0 |
| on #100 | 25.4 |
| on #200 | 31.5 |
| on #325 | 16.5 |
| through #325 | 25.9 |

EXAMPLE 2

The following formulations are prepared and their properties are measured as indicated below:

The ingredients are mixed in the following order: water, color, clay, one half of the phosphate, defoamer, hypochlorite, sodium carbonate, potassium carbonate, NaOH, silicate, second half of phosphate, surfactant.

| | Proportions | | | | |
|---|---|---|---|---|---|
| | a | b | c | d | e |
| Ingredients | | | | | |
| Clay (attagel 50) | 3.285 | 3.285 | 3.285 | 3.285 | 3.285 |
| STPP | 23.0 | 23.0 | 17.01 | 16.5 | 23.0 |
| Potassium tripolyphosphate | — | — | — | 6.5 | — |
| Potassium Pyrophosphate | — | — | 5.99 | — | 0 |
| Sodium Carbonate | 5.0 | — | 5.0 | 5.0 | 2.5 |
| Potassium Carbonate | — | 5.0 | — | — | 2.5 |
| Sodium Hypochlorite (12%) | 9.375 | 9.375 | 9.375 | 9.375 | 9.375 |
| Sodium Hydroxide (50%) | 2.05 | 2.05 | 2.05 | 2.05 | 2.05 |
| Sodium Silicate (47.5%) | 10.53 | 10.53 | 10.53 | 10.53 | 10.53 |
| Surfactant (Dowfax 3B-2) | 0.80 | 0.80 | 0.80 | 0.80 | 0.80 |
| Defoamer (Knapsack LpKn) | 0.16 | 0.16 | 0.16 | 0.16 | 0.16 |
| Color | 0.381 | 0.381 | 0.381 | 0.381 | 0.381 |
| Water | | | Balance | | |
| Properties | | | | | |
| capillary drainage time (min.) | 8.2 | 12.1 | 10.9 | 11.4 | 11.2 |
| Viscosity (cps) on 100° F. aging | | | | | |
| 1 week | 9080 | 3100 | 2900 | 5120 | 5400 |
| 2 weeks | 9200 | 3480 | 2820 | 6340 | 5240 |
| 3 weeks | 9300 | 3600 | 3040 | 6700 | 6560 |

The capillary drainage time is a conventional test in which a 6.8 cm. diameter circle is drawn on a 15 cm diameter sheet of Whatman size 41 filter paper, a plastic annulus (3.5 cm inside diameter, 4.2 cm outside diameter, 6.0 cm high) is placed vertically, concentric with the circle, on the filter paper, and the annulus is filled with the composition to be tested. Liquid from the composition is thereby absorbed into the filter paper and spreads slowly to the drawn circle. The time which elapses until the liquid contacts the circle is measured at three predetermined locations and an average value is calculated.

EXAMPLE 3

The following formulations are prepared by mixing the ingredients in the order indicated. The compositions are then centrifuged at 275 G until there is no further increase in the volume of the clear separated liquid (continuous) phase and the resulting liquid is analyzed:

| | a | b | c | d |
|---|---|---|---|---|
| deionized water | 27.106 | → | → | → |
| color | 0.016 | → | → | → |
| sodium carbonate | 6 | 4 | 2 | 0 |
| potassium carbonate | 0 | 2 | 4 | 6 |
| STPP | 21.106 | → | → | → |
| deionized water | 14.184 | → | → | → |
| Attagel #50 | 4.00 | → | → | → |
| $T_1O_2$ | 0.444 | → | → | → |
| 50% solution of NaOH | 2.5 | → | → | → |
| 47.5% solution of sodium silicate | 13.684 | → | → | → |
| antifoam | 0.16 | → | → | → |
| 13% solution of NaOCl | 10.0 | → | → | → |
| 45% solution of surfactant | 0.8 | → | → | → |
| | 100.00 | | | |

Thus the compositions are identical except for their K:Na ratios.

| | a | b | c | d |
|---|---|---|---|---|
| Properties of Product | | | | |
| viscosity | | | | |
| after 1 day at room temperature | 8320 | 5520 | 4200 | 2120 |
| after 3 weeks at room temperature | 8550 | 6200 | 4500 | 2420 |
| after aging at 100° F. for 7 weeks | 9400 | 8000 | 5600 | 3400 |
| Specific gravity | 1.37 | 1.37 | 1.40 | 1.39 |
| Properties of liquid Obtained by Centrifuging | | | | |
| viscosity at 25° C. relative to water at 1 cps. | 4.4 | 4.4 | 4.8 | 6.3 |
| % soluble silicate (calculated at mol ratio $Na_2O:SiO_2$ of 1:2.4) | 7.5 | 7.3 | 7.3 | 7.1 |
| % carbonate (calculated as $Na_2CO_3$) | 8.8 | 8.5 | 7.4 | 6.6 |
| % phosphate (calculated as $Na_5P_3O_{10}$) | 1.7 | 2.5 | 3.7 | 6.1 |
| specific gravity | 1.257 | 1.262 | 1.276 | 1.30 |

The viscosities of the product for this Example are measured with a Brookfield RVT viscometer spindle No. 5 at 80° F. (26.7° C.).

Examples 4–6 below illustrate a new and useful method for making the products described above (containing limited amounts of potassium). It can also be used for making other products of the type shown in the previously mentioned U.S. Pat. No. 4,740,327 (e.g. in which the potassium compound is not present) as well as other detergent slurries comprising fine particles of water-soluble inorganic builder salts dispersed in water containing dissolved builder salt, clay or other colloidal thickening agent, and surfactant. In these Examples (in which the particles of builder salt in the product are largely STPP hexahydrate plus hydrated sodium carbonate) there is formed a highly viscous (e.g. 20,000–60,000 cps viscosity) mixture of a limited amount of water, a highly alkaline saturated solution of builder salts and, as the major constituent, undissolved particles of water-soluble builder salt. This viscous mixture is subjected to grinding of the undissolved particles with a high speed disperser after which solid particles of the clay thickener are added and the clay is mechanically deagglomerated; thereafter the balance of the ingredients of the formula (e.g., other liquids or materials which readily dissolve or disperse in the liquid phase of high electrolyte content) may be mixed in. The mixture may then be subjected to additional high shear mechanical action to further deagglomerate the clay. It is found that with this method pre-dispersion of the clay in aqueous medium is not needed. The solid particles of clay readily disperse even though the medium is highly alkaline. The grinding of the undissolved builder salt particles takes place much more efficiently and rapidly in the substantial absence of the clay.

In the method illustrated in Examples 4–6 the builder salt which is to constitute the major portion of the undissolved particles is preferably added to an aqueous solution which already contains such a high concentration of dissolved other builder salt that this addition causes builder salt to be thrown out of solution (e.g. by common ion effect) and thus to recrystallize as tiny crystals.

Another significant feature of the mixing method illustrated in Examples 4–6 is the fact that it enables repeated batches of reproducible properties to be made using the entire "heel" of the previously formed batch as an ingredient of each successive batch.

As indicated earlier, the use of the process illustrated in Examples 4–6 is not limited to the making of compositions containing potassium salts. While it has thus far found its greatest utility in making formulations in which the clay is attapulgite, it may also be employed for compositions in which all, or part, of the clay is of the swelling type, e.g., a smectite type of clay such as bentonite (e.g., Gelwhite GP) or hectorite.

EXAMPLE 4

In 32.0 parts of deionized water mixed with a small amount of a pigment (i.e., 0.028 parts of Graphtol green, an aqueous paste containing 28% pigment) there are completely dissolved 2.0 parts $K_2CO_3$ (whose water solubility is over 100 parts per 100 parts of water even at 0° C. and 5.0 parts granular sodium carbonate (whose water solubility is about 45 parts per 100 at 35° C.). The solution has a temperature of about 90° F. Then 23.116 parts of powdered STPP containing about 0.5% water of hydration are added while continuously subjecting the mixture to the action of a high speed disperser. The amount of STPP is much more than that which is soluble in the amount of water present; its solubility in water is about 20g per 100 ml at 25° C. In this example, the STPP is a product of Olin Corp. having a phase I content of about 50%, a sodium sulfate content of about 2%, and a very fine particle size, it is a blend of powdered anhydrous STPP made by the known "wet process" and powdered STPP hexahydrate. On adding the STPP to the solution it hydrates rapidly, forming hard crystalline lumps comprising STPP hexahydrate. (It will be noted that 23 parts of STPP has the capacity, in forming the hexahydrate, to take up about 7 parts of water). The mixture is at first a thin slurry of undissolved STPP in a liquid which is a supersaturated solution. The temperature rises owing to the hydration reaction, reaching a peak of about 140° F. In about 3 to 4 minutes the mixture becomes much more viscous; its viscosity rises to above 20,000 cps (such as about 40,000–50,000 cps as measured at the slurry temperature e.g. with a Brookfield RVT, spindle #6 at 10 RPM). It is believed that during the process, sodium carbonate crystallizes (in the form of very fine crystals) out of the solution phase owing to the common ion effect (of the sodium of the STPP). When the mixture has become viscous the high speed disperser acts to grind the particles (e.g. of hydrated TPP) to a fine particle size, the grinding action is indicated, for one thing, by the increased power consumption of the disperser and an additional rise in temperature (e.g., to 150° F., which causes increased dissolution of builder salts; these will, in turn, recrystallize in fine form on cooling). This grinding is continued for about 5 minutes after the initial thickening of the slurry; during grinding the visible lumps of material disappear and the particle size of the undissolved particles larger than about 40 microns size is reduced so that, it is believed, substantially all the particles have diameters below 40 microns. Then a further 9.367 parts of water are added, lowering the viscosity to less than 10,000 cps (e.g. in the neighborhood of 5000 cps, measured as indicated above), after which 3.3 parts of Attagel #50 and 0.732 parts of white $TiO_2$ (anatase) pigment are added to the highly alkaline mixture (whose pH is well over 9, e.g. 10.5) while the mixture is continuously subjected to the action of the high speed disperser, which disperses (deagglomerates) the clay to a large extent, so that the thick mixture becomes homogeneous and smooth in appearance. Then there are added 2.70 parts of 50% aqueous solution of NaOH, 0.16 parts of antifoam agent (Knapsack LPKN 158), 10.53 parts of 47.5% aqueous solution of sodium silicate (whose $Na_2O:SiO_2$ ratio is 1:2.4), 10.0 parts of a 12% aqueous solution of sodium hypochlorite and 0.8 part of a 45% aqueous solution of a bleach-resistant anionic surfactant (Dowfax 3B2); these additions may be made under any desired mixing conditions, e.g., with simple stirring (although it may be convenient to continue the high shear dispersing action for such mixing). The mixture is then subjected to a milling action, as by passing it through an in-line mill such as a Tekmar "Dispax Reactor" (which operates at a top speed of 22 meters per second) which subjects the mixture to a high shear rate for a relatively short time (e.g. the "residence time" in the mill may be merely two seconds or less). The principal effect of this is to further deagglomerate the clay particles, as indicated by a significant increase in the yield value, e.g. raising the yield value of the mixture by some 33%.

The resulting mixture is thixotropic. It is believed that the particle size of the dispersed solid particles therein is so small that some 80% by weight, or more, have particle sizes below 10 microns. The mixture is at a temperature in the neighborhood of 120°-130° F. (at this temperature its viscosity is higher than at say 70° F). It is drained off from the mixing vessel (e.g., from a bottom valve when the vessel has a conical bottom, or from a lower side valve of a substantially flat-bottomed mixing vessel). About 10% of the mixture remains as a "heel" in the vessel; owing to its flow characteristics it is difficult to remove all the composition from the vessel.

The entire procedure described above is then repeated over-and-over in the same mixing vessel without removing the heels at all.

The high-speed disperser may comprise a circular horizontal plate having alternately upwardly and downwardly extending circumferential teeth, which plate is mounted (on a vertical downwardly extending shaft) so as to rotate so rapidly that the crcumferential speed (of the teeth) is more than about 75 feet per second (e.g. 90 feet per second). For laboratory operation a Cowles high speed disperser is suitable; for larger scale operation a Myers model 800 series high speed disperser may be used. These high speed dispersers reduce particles by impact grinding by the toothed plate and by laminar shear stress on the mixture. The shear generates heat in the batch, in addition to the heat generated by the dissolving, hydration, etc. At the resulting relatively high temperature the ingredients are more soluble and on crystallization on cooling will give relatively small particles which do not settle rapidly if at all. The high speed disperser induces a "rolling" of the mixture i.e. the path of movement of the mixture is downward centrally of the vessel, outwardly along the rotating plate, upwardly along the side walls of the vessel and inwardly at the upper surface of the mixture. In the course of this movement desirable deaeration occurs, i.e., air (which is always introduced when powders are added) will leave the mixture during the inward leg of its circuit.

Figure 4:
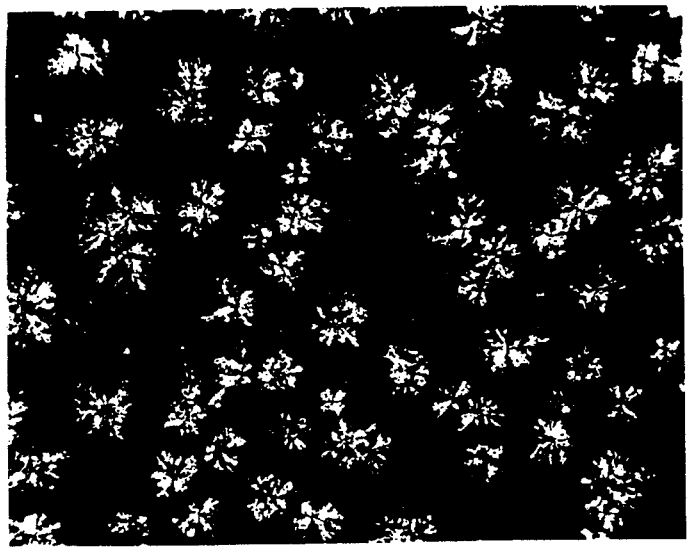
FIG. 4 is a photomicrograph (taken on the scale indicated thereon) of the composition of Example 4.

Apparently, after processing of the composition described above, crystal growth occurs to form many larger and relatively uniform-sized crystals (as shown by photomicrographs). Thus FIG. 4 indicates that crystals having diameters on the order of 80 microns are present. These crystals appear to contain polyphosphate but have not yet been fully indentified.

EXAMPLE 5

Example 4 is repeated except that the STPP powder is a Monsanto anhydrous STPP made by the known "dry process" and comprising anhydrous STPP humidified to the extent that its content of water of hydration is ½% (or somewhat higher, e.g. 1½%). Its phase I content is about 20%. This STPP was also used in Example 3.

EXAMPLE 6

Example 4 is repeated except that the initial proportion of water is 28.0 parts, the second proportion of water is 13.637 parts, and prior to the addition of the attapulgite clay there is added 1.11 parts of 45% aqueous solution of sodium polyacrylate (Acrysol LMW-45N, having a molecular weight of about 4500). The amount of $K_2CO_3$ here is 3 parts and the amount of $Na_2CO_3$ is 4 parts.

The products of Examples 4-6 were found to have the following characteristics:

| | Example | | |
|---|---|---|---|
| | 4 | 5 | 6 |
| viscosity (cps) | 4000 | 6000 | 4400 |
| yield value (dynes/cm$^2$) | 450 | 600 | 450 |
| capillary drainage time (min) | 8.2 | 5.6 | 6.1 |
| centrifugal separation (%) | 16 | 26.3 | 12 |
| Thixotropy index | 5 | 4.3 | 4.1 |

"Centrifugal separation" is measured by centrifuging at 275G as described in Example 3, above, and measuring the volume of the clear liquid layer in relation to the total volume.

"Thixotropy index" is the ratio of the viscosity at 30 rpm to that at 3 rpm, measured at room temperature with a Brookfield HATD viscometer, #4 spindle, as described in said U.S. Pat. No. 4,740,327.

In Example 6 a soluble chlorine bleach-resistant polymer is present. It is found that the presence of the polymer improves the resistance to separation of the product on standing or on centrifuging, without imparting a correspondingly large increase in the viscosity of the product. It will be appreciated that the polymer is present here in a very highly concentrated (saturated) electrolyte solution. It is also found that the presence of the polymer leads to improved protection of the overglaze layer of dishware (fine china). In work, thus far, these effects have been observed with polyacrylic acid salts, which have been found to be entirely compatible with chlorine bleach and with the clay in this system, e.g. the active chlorine content is maintained, as is the viscosity. Polymers of different molecular weights may be used; for instance, the polymer may have a molecular weight less than 10,000 or a molecular weight of 100,000 or more. Preferred molecular weights range from about 1,000 to 500,000. Molecular weights of from about 1000 to 50,000 are particularly notable for providing less filming on glass. The proportions of polymer may be in the range of 0.01 to 3% with the lower proportions being more suitable for the higher molecular weight polymers (e.g. 0.06% for a 300,000 molecular weight polymer). Other bleach-resistant polymers may be employed e.g. Tancol 731 which is a sodium salt of a polymeric carboxylic acid having a M.W. of about 15000.

In this application all proportions are by weight unless othewise indicated. In the Examples atmospheric pressure is used unless otherwise indicated.

It is understood that the foregoing detailed description is given merely by way of illustration and that variations may be made therein without departing from the spirt of the invention.

I claim:

1. A process for making an aqueous thixotropic dishwasher detergent composition comprising by weight:

(a) 8 to 35% alkali metal tripolyphosphate,
(b) 2.5 to 20% alkali metal silicate,
(c) 0 to 9% alkali metal carbonate,
(d) 0.1 to 5% chlorine bleach stable, water dispersible organic detergent active material,
(e) 0 to 5% chlorine bleach stable foam depressant,
(f) chlorine bleach compound in an amount to provide about 0.2 to 4% of available chlorine,
(g) thixotropic clay thickener in an amount sufficient to provide the composition with a thixotropy index of about 2.5 to 10.0, and
(h) 40 to 50% water; said process comprising the steps of:

1. mixing water containing dissolved alkali metal carbonate with a sufficient amount of alkali metal tripolyphosphate detergent builder salt to obtain a viscous mixture having a viscosity of 20,000 to 60,000 centipoises,
2. subjecting said viscous mixture to high speed dispersing to effect wet grinding of said builder salt to a particle size of less than about 40 microns,
3. adding a sufficient amount of water to reduce the viscosity of the wet ground mixture to less than 10,000 centipoises,
4. high speed dispersing said wet ground mixture while adding powdered clay thickener to obtain a homogeneous and smooth viscous mixture, and
5. adding to the smooth viscous mixture the remaining ingredients so as to produce the thixotropic detergent composition.

2. The process of claim 1 wherein in step 1 there is added to the water 20 to 30% sodium tripolyphosphate based on weight of the detergent composition.

3. The process of claim 1 wherein in step 1 there is added to the water 2 to 7% alkali metal carbonate based on weight of the detergent composition.

4. The process of claim 1 wherein in step 4 there is added to said wet ground mixture 1 to 5% powdered clay thickener based on weight of the detergent composition.

5. The process of claim 1 wherein in step 5 there is added to the viscous mixture chlorine bleach in an amount to provide 0.5 to 2% available chlorine, and 0.1 to 0.5% of a detergent, based on weight of the detergent composition.

6. The process of claim 1 wherein water comprises 43 to 48%, based on weight of the detergent composition.

7. The process of claim 1 wherein in:

step 1, 2.0 parts of $K_2CO_3$, 5.0 parts $Na_2CO_3$ and 23.116 parts of sodium tripolyphosphate are added to 32.0 parts by weight of water,
step 3, 9.367 parts of water are added to the viscous mixture,
step 4, 3.3 parts of clay thickener and 0.732 parts of white $TiO_2$ pigment are added to the viscous mixture, and
step 5, 2.7 parts of 50% aqueous solution of NaOH, 0.16 parts of anti-foam agent, 10.53 parts of 47.5% aqueous solution of sodium silicate, 10.0 parts of 12% aqueous solution of sodium hypochlorite and 0.8 parts of a 45% solution of a bleach resistant anionic surfactant are added to the viscous mixture.

8. The process of claim 1 wherein after high speed dispersing in step 4, 80% of the builder salt particles are less than 10 microns in size.

9. The process of claim 1 wherein in step 5 there is added to the viscous mixture a chlorine bleach compound in an amount to provide at least about 0.5% available chlorine and from about 0.1 to about 0.5% by weight detergent active material.

10. A process for preparing an aqueous thixotropic dishwasher detergent composition comprising a chlorine bleach stable surfactant, a thixotropic thickener in an amount sufficient to provide the composition with a thixotropy index of about 2.5 to 10.0; from about 10.5 to about 64% of inorganic components comprising alkali metal tripolyphosphate, alkali metal carbonates, and alkali metal silicates, a chlorine bleach compound in an amount to provide about 0.2 to 4% available chlorine; and wherein the final composition contains from about 40% to about 50% water, comprising the steps of:

(a) mixing the alkali metal carbonate, alkali metal tripolyphosphate and water to form a viscous mixture wherein the proportion of said tripolyphosphate to said water is effective to provide a viscosity of about 20,000 to about 60,000 centipoises;
(b) high shear mixing said viscous mixture so as to grind substantially all dispersed solid particles in said mixture to a size less than about 40 microns;
(c) adding water to said high sheared viscous mixture in an amount effective to reduce the viscosity of said mixture to less than about 10,000 centipoises;
(d) adding the thixotropic thickener to the reduced viscosity mixture while high shear mixing so as to deagglomerate and disperse said thickener throughout said mixture;
(e) mixing said thixotropic thickened viscous mixture with the alkali metal silicates and surfactant to produce a detergent composition; and
(f) high shear mixing said detergent composition to further deagglomerate any solid particles so as to produce a smooth thixotropic dishwasher detergent composition.

11. The process of claim 10 wherein the detergent composition contains from about 8% to about 35% by weight alkali metal tripolyphosphates.

12. The process of claim 10 wherein the detergent composition contains from about 2% to about 7% by weight alkali metal carbonate.

13. The process of claim 10 wherein the detergent composition contains from about 0.1% to about 0.5% by weight surfactant.

14. The process of claim 10 wherein about 80% of the solid particles in the thixotropic automatic dishwasher detergent composition are less than about 10 microns.

15. Process as in claim 10 in which the concentration of said alkali metal carbonate in said viscous mixture is such that the added sodium tripolyphosphate causes crystallization of sodium carbonate from said solution.

16. The process of claim 10 wherein water comprises 43 to 48% based on weight of the detergent composition.

17. The process of claim 10 wherein said thixotropic thickener is powdered attapulgite clay.

18. Process as in claim 17 in which the proportion of said clay thickener is about 1 to 5%.

* * * * *